US005318333A

United States Patent [19]

Dreifert

[11] Patent Number: 5,318,333

[45] Date of Patent: Jun. 7, 1994

[54] DEVICE FOR LOCKING AND UNLOCKING SASHES IN DOOR- OR WINDOW FRAMES

[75] Inventor: Karl-Heinz Dreifert, Velbert, Fed. Rep. of Germany

[73] Assignee: Wilhelm Weidtmann GmbH & Co. KG, Velbert, Fed. Rep. of Germany

[21] Appl. No.: 49,087

[22] Filed: Apr. 20, 1993

[30] Foreign Application Priority Data

Apr. 23, 1992 [DE] Fed. Rep. of Germany ..... 4213337

[51] Int. Cl.[5] ..... E05C 902

[52] U.S. Cl. ..... 292/336.3; 292/36; 292/37

[58] Field of Search ..... 292/336.3, 40, 34, 36, 292/167, 165, 37, 173

[56] References Cited

U.S. PATENT DOCUMENTS

| | | | |
|---|---|---|---|
| 2,350,844 | 6/1944 | Von Der Luen | 292/40 X |
| 3,400,562 | 9/1968 | Bloss | 292/36 |
| 4,470,277 | 9/1984 | Uyeda | 292/34 X |

FOREIGN PATENT DOCUMENTS

| | | | |
|---|---|---|---|
| 2341263 | 3/1974 | Fed. Rep. of Germany | 292/40 |
| 744370 | 1/1933 | France | 292/40 |

*Primary Examiner*—Richard E. Moore
*Attorney, Agent, or Firm*—Darby & Darby

[57] ABSTRACT

A device which can lock a sash to and unlock a sash from a door or window frame has a composite housing which is partially recessed into the frame and receives a portion of a reciprocable plate member which is coupled to one or more motion receiving elements serving to actually lock or unlock the sash. The housing further carries a handle which is pivotable in the plane of the plate member about an axis extending at right angles to such plane, preferably through an angle of approximately 180°. The plate member has one or more sliders which are reciprocable in one or more elongated grooves provided in one or more internal surfaces of the housing. The motion transmitting connection between the handle and the plate member can include a single part, such as a crank, which is non-rotatably connected to the handle and is pivoted to the plate member. Alternatively, the motion transmitting connection can comprise a crank which is non-rotatably connected with the handle and a link which is articulately connected to and forms with the crank a toggle joint. An end portion of the link is articulately connected to the plate member.

20 Claims, 7 Drawing Sheets

DEVICE FOR LOCKING AND UNLOCKING SASHES IN DOOR- OR WINDOW FRAMES

BACKGROUND OF THE INVENTION

The present invention relates to mechanisms for locking movable parts to and for permitting movements of such parts relative to second parts which may but need not be stationary. More particularly, the invention relates to improvements in devices for actuating such mechanisms. Still more particularly, the invention relates to improvements in devices for actuating mechanisms which can releasably secure mobile first frames (e.g., sashes) to second frames, e.g., for actuating mechanisms which can releasably secure sashes to window- or door frames.

Mechanisms of the above outlined character are installed in one of the two frames (e.g., in a stationary door- or window frame, and can receive motion in response to proper manipulation of a knob, lever or a like handle to thereby terminate the locking connection between the two frames (so that the mobile frame can be moved to a partly open or to a fully open position relative to the second frame and thereupon back to the position for releasably locking the two frames to each other). In many instances, the connection between a handle and the locking- or unlocking mechanism will comprise one or more reciprocable motion receiving elements which are mounted in one of the frames and are set in motion in response to manipulation (e.g., pivoting or turning) of the handle. The handle can be pivotably mounted in a housing which is affixed to one of the frames and enables the handle to turn about an axis which is normal to the adjacent side of the frame serving to support the housing. The handle can transmit motion to a plate-like member which, in turn, transmits motion to the motion receiving element or elements of the mechanism.

German Utility Model No. 1 745 936 of Aluminium-Walzwerke Singen GmbH (published Mar. 20, 1957) discloses a device which can releasably lock a sash to a door- or window frame and wherein the handle constitutes one arm and a plate member constitutes another arm of a two-armed lever. The plate member is bifurcated and extends from a housing which contains the pivot for the two-armed lever. The bifurcated portion of the plate member can receive a pin which transmits motion to the motion receiving element or elements in response to pivoting of the two-armed lever relative to the housing. The lever can be pivoted to any one of several positions in each of which the mechanism assumes a different condition (e.g., a locking and an unlocking state). The extent of movability of the motion receiving element or elements in the device which is disclosed in the German Utility Model is limited, primarily because the dimensions of the bifurcated portion of the plate member must be increased if such element or elements are to be moved through greater distances. On the other hand, the dimensions of the two-armed lever cannot be increased at will because this would detract from the appearance of the device and would prevent installation of such device in an available frame. Moreover, the plate member cannot be pivoted to any desired number of satisfactory angular positions because a large force would be required to pivot the handle in order to lock the mobile frame to or to unlock the mobile frame from the other frame. As a rule, the force which is required to pivot the handle and the associated plate member will increase if the extent of angular displacement of the handle is increased. Such angular displacement takes place in a plane normal to the plane of the adjacent side of that frame which carries the housing for the pivot member supporting the two-armed lever. The mechanism is likely to block if the angular displacement of the lever is increased beyond a certain value. Therefore, the device which is disclosed in the German Utility Model is useful only when the extent of angular displacement of the two-armed lever between its end positions is relatively small, i.e., if the extent of linear or other displacement of the motion receiving element or elements is also small. This is unacceptable in many types of locking-unlocking mechanisms for door- or window sashes. The two-armed lever wherein the plate member is compelled to share all angular movements of the handle contributes to the bulk of the aforedescribed conventional device.

German Utility Model No. 1 822 045 of Grossmeyer (published Aug. 30, 1960) discloses a locking device for window sashes which are made of aluminum. A handle is pivotable about an axis defined by a pivot member in a housing which is outwardly adjacent a frame. The handle constitutes one arm of a two-armed lever which further includes a bifurcated plate-like second arm in engagement with a profiled motion transmitting part which is shiftable in the frame in response to pivoting of the handle to thereby displace a motion receiving element in the frame. The second arm of the lever is confined in the housing which latter further receives a major part of the profiled motion transmitting member. All this contributes to the bulk of the device of Grossmeyer. The drawbacks of the just described device are similar to those outlined hereinbefore in connection with the device of Aluminium-Walzwerke Singen GmbH.

German Utility Model No. 71 07 673 of Friedrich Hahn GmbH (published Jun. 24, 1971) discloses a device wherein the handle is pivotable in a plane which is parallel to the adjacent exposed side of a frame. Such frame supports a rather large and bulky housing which confines all or nearly all parts serving to displace a motion receiving element in response to pivoting of the handle. Furthermore, it is necessary to exert a large force in order to move the motion receiving element to certain positions relative to the frame.

OBJECTS OF THE INVENTION

An object of the invention is to provide a simple and inexpensive device which can be used to actuate a locking-unlocking mechanism, particularly a mechanism which can releasably secure a mobile frame (e.g., a door- or window sash) to a second frame (such as a stationary door- or window frame).

Another object of the invention is to provide a device which can be installed in or on a frame in a simple and time-saving manner.

A further object of the invention is to provide a device which can be designed to move one or more motion receiving parts through distances of desired or required magnitude without affecting the appearance and/or the convenience of manipulation of such device.

An additional object of the invention is to provide a device which can be manipulated by hand with the exertion of a relatively small force irrespective of the position of its handle.

Still another object of the invention is to provide a novel and improved combination of parts which transmit motion from the handle to the motion receiving element or elements of the above outlined device.

A further object of the invention is to provide a window or door which embodies a device of the above outlined character.

Another object of the invention is to provide a novel and improved mounting for the handle on or in the housing of the above outlined device.

An additional object of the invention is to provide a device which occupies a surprisingly small amount of space in spite of its ability to move one or more motion receiving elements through considerable distances.

Still another object of the invention is to provide a device which constitutes an improvement over and a further development of the aforedescribed conventional devices.

A further object of the invention is to provide a novel and improved method of transmitting motion between a locking-unlocking mechanism and an actuating device in a door or window wherein a sash or another mobile frame is to be releasably affixed to a second frame.

Another object of the invention is to provide novel and improved means for limiting and/or blocking the movements of various mobile components of the above outlined device.

SUMMARY OF THE INVENTION

The invention is embodied in a device which can be utilized to actuate a mechanism for releasably securing a mobile frame to a second frame, particularly for securing a mobile sash to a door- or window frame. The improved device comprises a relatively thin housing (see 84) including a first section and a second section and each of these sections has an external surface and an internal surface. The internal surfaces of the two sections confront each other and the device further comprises means (e.g., bolts and nuts, screws or the like) for fastening at least one of the two sections to one side of one of the frames (e.g., a window frame). Still further, the device comprises a pivot which is carried by the housing and defines a pivot axis extending at least substantially at right angles to the one side of the one frame, and a handle (e.g., in the form of a two-armed lever) which is mounted on the pivot adjacent one of the two external surfaces and is turnable about the pivot axis through an angle of at least 90° in a predetermined plane which is at least substantially parallel to at least one of the internal surfaces. The improved device further comprises a plate member including a first portion which is movably mounted between the sections of the housing and a second portion which extends outwardly from the housing through an opening provided between the two sections adjacent the one side of the one frame. The plate member has first and second sides which may but need not be parallel to each other, and the device comprises motion receiving means (e.g., one or more elongated bars or rods) connected to the second portion of the plate member and to the securing mechanism. Still further, the device comprises means for coupling the first portion of the plate member to the handle in order to impart to the motion receiving means a substantially linear movement in a predetermined direction in response to turning of the handle about the pivot axis. The coupling means comprises at least one follower which is provided on the plate member and is reciprocable in an elongated groove provided in one of the two internal surfaces adjacent one side of the plate member and extending in substantial parallelism with the predetermined direction of movement of the motion receiving means, a crank which is turnable with the handle and is disposed between the two sections of the housing adjacent the other side of the plate member, and means for at least indirectly connecting an end portion of the crank to the plate member. The end portion of the crank is movable (in response to turning of the handle about the pivot axis) along an arcuate path which crosses the groove and is disposed in a plane at least substantially parallel to the one side of the one frame.

The plate member is or can be located in a plane which is at least substantially normal to the one side of the frame, and the motion receiving means is preferably movable between a first position in which a mobile sash is secured to the frame and a second position in which the sash is movable relative to the frame. The first and second sections of the housing can include first and second walls, respectively, and the aforementioned internal surfaces are then provided on the respective walls. The handle is preferably turnable through an angle of approximately 180°, and the crank is preferably adjacent the internal surface of that section which includes the one external surface. The arcuate path for the end portion of the crank preferably constitutes (or can constitute) a portion of a substantially circular path.

In accordance with a first presently preferred embodiment of the invention, the means for at least indirectly connecting the crank with the plate member comprises a projection which is provided on the end portion of the crank and extends into a recess (e.g., a slot) provided in the plate member and extending at least substantially at right angles to the one side of the frame. The slot can be machined into or otherwise formed in the plate member in such a way that it includes a first portion in the first portion of the plate member and a second portion in the second portion of the plate member. Such slot preferably crosses the groove in the one internal surface. The plate member can be provided with two distancing elements which are adjacent the other internal surface and flank the slot. The handle is preferably mounted in such a way that it is turnable between spaced-apart first and second positions and the section which includes the other internal surface can be provided with two receiving means (hereinafter called pockets for short). One of these pockets receives one of the two distancing elements in the first position of the handle, and the other pocket receives the other distancing element in the second position of the handle. The slot is preferably elongated so that it has first and second ends, and the plate member is preferably movable by the crank (a) between a first end position in which the projection of the end portion of the crank is disposed at one end of the slot, (b) through a plurality of intermediate positions including a predetermined intermediate position in which the projection is at least close to the other end of the slot, and (c) a second end position in which the projection is again located at the one end of the slot. The arrangement can be such that the plate member is movable between first and second end positions in response to turning of the handle about the pivot axis between first and second positions, respectively. The projection is nearer to the one side of the frame than the pivot axis at least in the first position of the handle and the latter is further turnable to an end position beyond the first position and away from the second position to thereby locate the projection farther away from the one side of the frame than the pivot axis. In other words, the projection can be moved beyond a dead-center position to thus ensure that the handle remains in the end position until and unless it is intentionally moved to (and if necessary) beyond the first position.

In accordance with another presently preferred embodiment of the invention, the means for at least indirectly connecting the crank with the plate member comprises a link which is articulately connected with the end portion of the crank and is further connected to the plate member. The link and the crank together form a toggle joint and the handle can move the plate member between first and second end positions. The link and the crank are inclined relative to each other (e.g., they can make an acute angle) in one end position of the plate member, and the link is or can be at least substantially aligned with the crank in the other end position of the plate member. In this embodiment of the improved device, the means for at least indirectly connecting the crank to the plate member can further comprise a first fulcrum which connects the link to the crank and defines a second axis at least substantially parallel to the pivot axis, and a second fulcrum which connects the link with the plate member and defines a third axis parallel to the second axis. The plate member is movable between first and second end positions in response to turning of the handle about the pivot axis between first and second positions, respectively. The second axis is disposed at least close to a common plate of the pivot axis and the third axis in the first end position of the plate member, and the handle is preferably turnable about the pivot axis beyond the first position and further away from the second position to thus locate the second axis at one side of the aforementioned common plane. The first fulcrum can be provided with an axial extension which extends into a guide groove provided in the other internal surface of the housing.

The improved device can further comprise a detent having means for releasably holding the handle in at least one of the first and second positions. Such detent can comprise at least one recess in the crank and a male detent member which is provided on the housing to enter the at least one recess of the crank in the at least one position of the handle. The male detent member can comprise a leaf spring or a torsion spring having two legs which are mounted on one of the two sections of the housing, and a protuberance which is disposed between the two legs and enters the at least one recess in the at least one position of the handle. The other section of the housing can be provided with means for maintaining the legs of the spring in predetermined positions relative to the one section, at least during assembly of the two sections into a housing.

The one external surface of the housing can be provided with a depression for a portion of the handle, particularly the portion which is immediately adjacent the pivot axis.

The at least one follower of the plate member can comprise at least one slider (e.g., a round roller-shaped slider and/or a substantially oval slider), and such slider can be provided with a lubricant-containing chamber. Analogously, the extension of the second fulcrum can be provided with a lubricant-containing chamber.

The improved device can further comprise locking means mounted on one of the housing sections and having a movable locking element (e.g., a reciprocable or pivotable bolt or hook) and means (e.g., a key) for moving (or for effecting a movement of) the locking element into and from locking engagement with the plate member, with the handle, with the crank or with the toggle joint.

The housing of the improved device can comprise at least one stop which is positioned to prevent a movement of the plate member beyond at least one of the two end positions of the plate member. The stop or stops can act directly against the plate member or such stop or stops can be designed and positioned to indirectly prevent further movement of the plate member between the first and/or second end position, e.g., by arresting the toggle joint, the crank, the handle, the link or any other part in the power train from the hand of an operator to the motion receiving means.

The novel features which are considered as characteristic of the invention are set forth in particular in the appended claims. The improved device itself, however, both as to its construction and the mode of installing and operating the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 3:
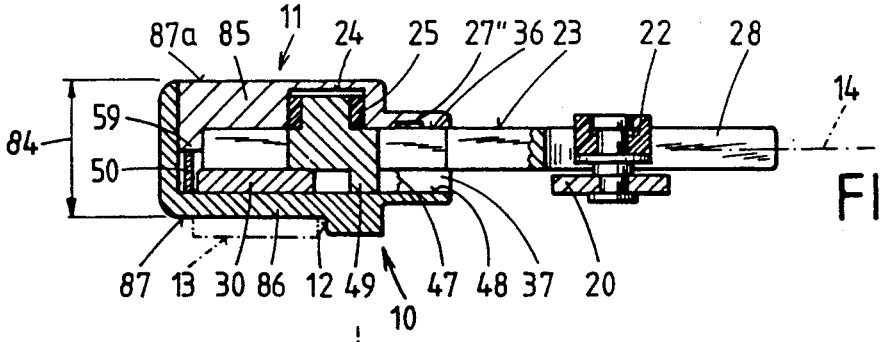
FIG. 3 is a sectional view substantially as seen in the direction of arrows from the line III—III in FIG. 1.

The device which is shown in FIGS. 1 to 7 comprises a composite flat housing or casing including a first section 10 and a second section or cover 11. The housing (and particularly the section 10) accommodates a number of component parts including a plate member 23 having a first portion within the confines of the housing and a second portion 90 which is located outside of the housing and serves to transmit motion to one or more motion receiving elements 20, e.g., a linkage which can actuate a mechanism serving to unlock or lock a mobile sash (not shown) carried by a stationary frame. The front or exposed side of the frame is indicated by a phantom line 19. The plane of separation between the sections 10, 11 of the housing extends through an opening 37 which permits the second portion 90 of the plate member 23 to extend from the housing. The section 10 includes a wall 86 at one side of the first portion of the plate member 23, and the section 11 includes a wall 85 at the other side of the plate member 23. The external surface 87 of the wall 86 has a recess adjacent a shoulder 12 and serving to receive a portion of an elongated handle 13 pivotable relative to the frame about an axis defined by a crank pin 31 (see particularly FIG. 6). The external surface of the wall 85 is shown at 87*a*. The plane in which the handle 13 is pivotable relative to the housing is denoted by a phantom-line 14; this plane is normal to the front side 19 of the frame.

As shown in FIG. 3 by phantom lines, that portion of the handle 13 which is immediately adjacent the shoulder 12 has an outer side which is flush or nearly flush with the adjacent portion of the external surface 87 of the wall 86 forming part of the section 10.

The pin 31 which defines a pivot axis for the handle 13 is received in a sleeve 15 which, in turn, is installed in the wall 86 of the section 10. The directions in which the handle 13 is pivotable toward and away from a (first) position (shown in FIG. 1 by solid lines) are indicated by arrows 16 and 16'. The handle 13 is pivotable through an angle of at least substantially 180° between the solid-line first position of FIG. 1, through a plurality of intermediate positions including the intermediate position shown in FIG. 5 and the other or second position shown in FIG. 7.

Figure 1:
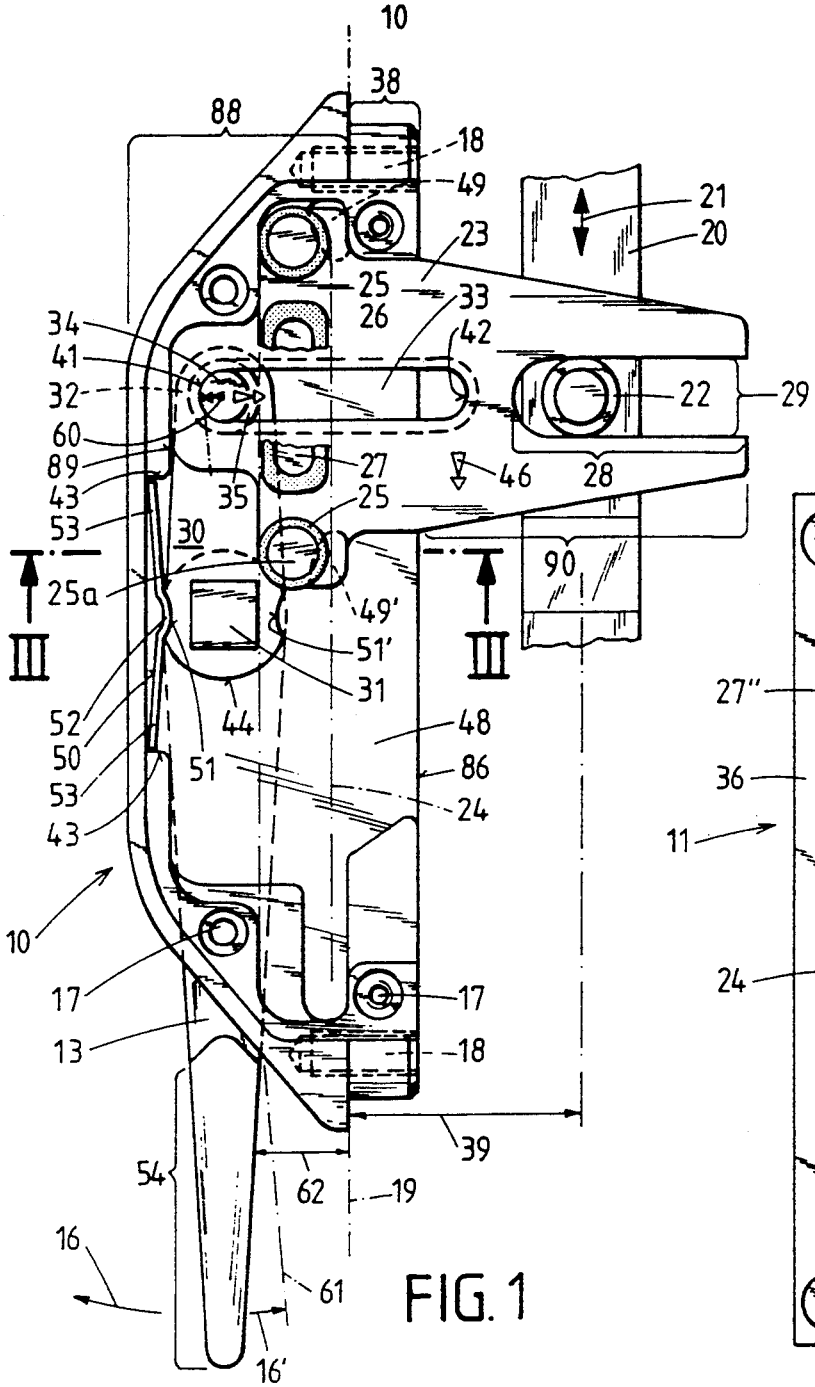
FIG. 1 is a side elevational view of a device which embodies one form of the invention, one section of the housing being omitted and the handle being shown in a (first) position in which a sash or another mobile part (not shown) can be moved relative to a second part, e.g., a stationary door- or window frame.
Figure 2:
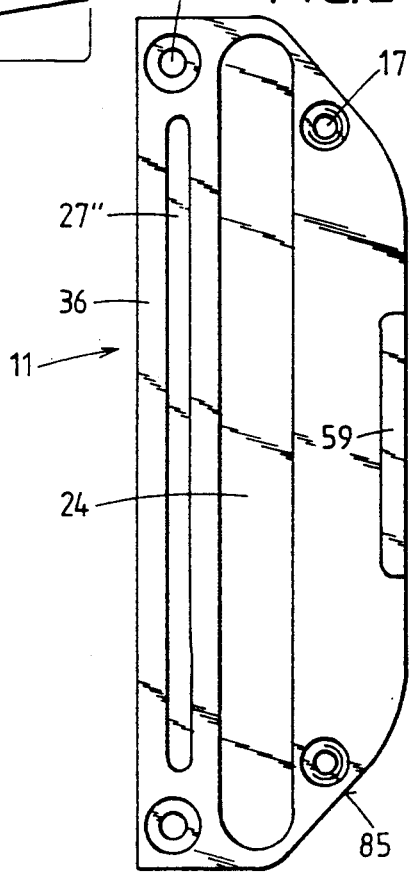
FIG. 2 is a plan view of the internal surface of a housing shows the elongated groove which is provided in such internal surface.
Figure 6:
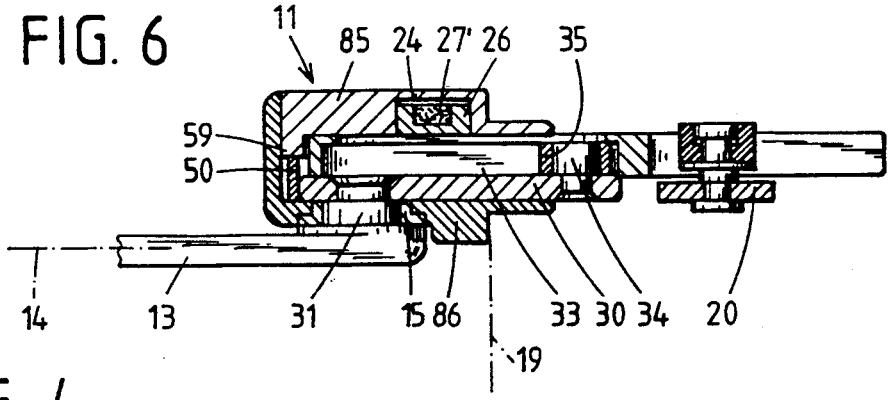
FIG. 6 is a sectional view substantially as seen in the direction of arrows from the line VI—VI in FIG. 5, with the handle partly broken away.
Figure 4:
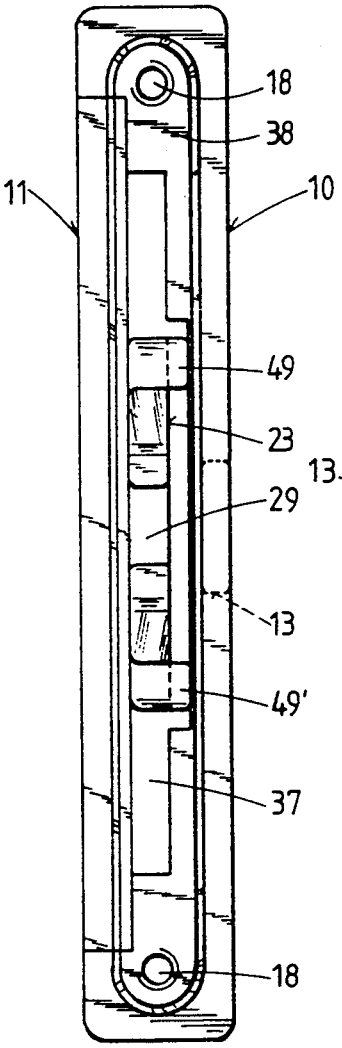
FIG. 4 is an end elevational view as seen in the direction of arrow IV in FIG. 5, with the handle indicated by phantom lines.

The reference characters 17 denote fasteners (e.g., rivets, bolts and nuts or screws) which secure the sections 10, 11 to each other, and additional fasteners 18 are provided to secure the housing including the sections 10, 11 to the frame. As shown in FIG. 1 at 38, the sections 10, 11 of the housing can be partially recessed into the side 19 of the frame; this reduces the dimensions (see 88 in FIG. 1) of that part of the improved device which extends outwardly beyond the side 19. The side 19 can form part of a door or window frame, and such frame can carry a sash which can be locked to or unlocked from the frame in response to appropriate manipulation of the handle 13. The frame including the side 19 is assumed to be stationary. The pivot axis which is defined by the pin 31 for the handle 13 is parallel to the side 19.

The motion receiving element or elements 20 (hereinafter called element) are articulately connected to the portion 90 of the plate member 23 and mounted for reciprocatory movement in directions indicated by a double-headed arrow 21. The element 20 is movably installed in the frame and carries one or more parts which are designed to lock the sash to the frame or to permit the sash to pivot and/or otherwise move with reference to the frame. For example, the element 20 can assume the position of FIG. 1 when the sash is locked to the frame, and the element 20 can assume the position of FIG. 7 when the sash is unlocked so that it can be pivoted relative to the frame.

The means for coupling the handle 13 with the plate member 23 (which is connected to the motion receiving element 20) includes a crank 30 which is installed in the housing including the sections 10, 11 at one side of the plate member 23. The latter is reciprocable in the housing and comprises a set of followers in the form of sliders 25, 26, 25 which are received in an elongated groove 24 provided therefor in the internal surface 36 of the wall 85 forming part of the section or cover 11. Each of the two preferably identical sliders 25 comprises a roller which is mounted on a stub 25*a* of the plate member 23, and the slider 26 is located between the two circular sliders 25 and can have an oval or polygonal outline. The sliders 25 are adjacent the two ends of that (first) portion of the plate member 23 which is confined between the sections 10, 11. The three sliders 25, 25, 26 cooperate with the surfaces bounding the straight elongated groove 24 to ensure that the plate member 23 is confined to reciprocatory movements in directions indicated by the double-headed arrow 21. A portion of the slider 26 is broken away in FIG. 1 in order to show certain parts which are normally overlapped by the plate member 23. At least the elongated slider 26 is provided with a recess or chamber 27 which can confine a supply of lubricant 27' (FIG. 6) to be distributed along the surfaces bounding the groove 24 when the improved device is in use.

The plate member 23 is confined to reciprocatory movements longitudinally of the groove 24 in the plane 14, i.e., between the internal surfaces 48, 36 of the two sections 10, 11 of the housing and at right angles to the pivot axis of the handle 13. FIG. 3 shows, at 27", that the internal surface 36 of the housing section 11 can be provided with at least one additional lubricant receiving chamber to ensure adequate lubrication of the respective side of the plate member 23. One or more additional lubricant containing chambers can be provided in the internal surface 48 to lubricate the other side of the plate member 23.

That side of the plate member 23 which is adjacent the internal surface 48 is provided with two spaced apart distancing elements 49, 49' which abut the internal surface 48 and provide a clearance 47 (FIG. 3) for the crank 30. An elongated slot 33 partly in the first portion of the plate member 23 (within the housing including the sections 10 and 11) is aligned with a slot 29 which is provided in the second portion 90 of the plate member 23 and receives a follower 22. The follower 22 is located between two prongs 28 which form part of the plate member 23 and ensure that the element 20 shares the movements of the plate member, namely the movements in the directions indicated by the arrow 21.

The slot 29 is sufficiently long to permit the placing of the element 20 at a selected distance 39 (FIG. 1) from the side 19 of the frame. This contributes to the versatility of the improved device.

The crank 30 is non-rotatably connected with the handle 13 and is installed between the internal surface 48 of the housing section 10 and the adjacent side of the first portion of the plate member 23. The pin 31 can be of one piece with the handle 13 and is then non-rotatably installed in one end portion of the crank 30. Alternatively, the pin 31 can be of one piece with the crank 30 and is then non-rotatably secured to the handle 13. That end portion (32) of the crank 30 which is remote from the pin 31 is provided with a pin or post or fulcrum 34 which extends into the elongated slot 33 of the plate member 23. The slots 33 and 29 extend at right angles to the side 19 of the frame as well as at right angles to the groove 24 and the directions indicated by the double-headed arrow 21.

The pin 34 on the end portion 32 of the crank 30 is surrounded by a roller 35 which engages the surface surrounding the slot 33. The roller 35 can be loosely slipped onto the pin 34 and can be maintained in requisite position by a stepped surface surrounding the slot 33 (see FIG. 6). This ensures that, once the housing is assembled with the crank 30, plate member 23 and handle 13, the roller 35 is maintained in a desired axial position within the slot 33.

The slot 33 extends in part into the first portion and in part into the second portion 90 of the plate member 23. When the handle 13 assumes the first position of FIG. 1, the pin 34 and its roller 35 are located in the left-hand end portion 41 of the slot 33 at a maximum distance from the slot 29, i.e., within the confines of the housing including the sections 10 and 11. The handle 13 is then at least substantially parallel to the side 19 of the frame and to the directions (arrow 21) of reciprocatory movement of the motion receiving element 20. One or more hooks, teeth, pins or like projections on the element 20 then engage complementary projections or extend into complementary recesses of the hardware in or on the sash so that the latter is locked to the frame including the exposed side 19.

Figure 7:
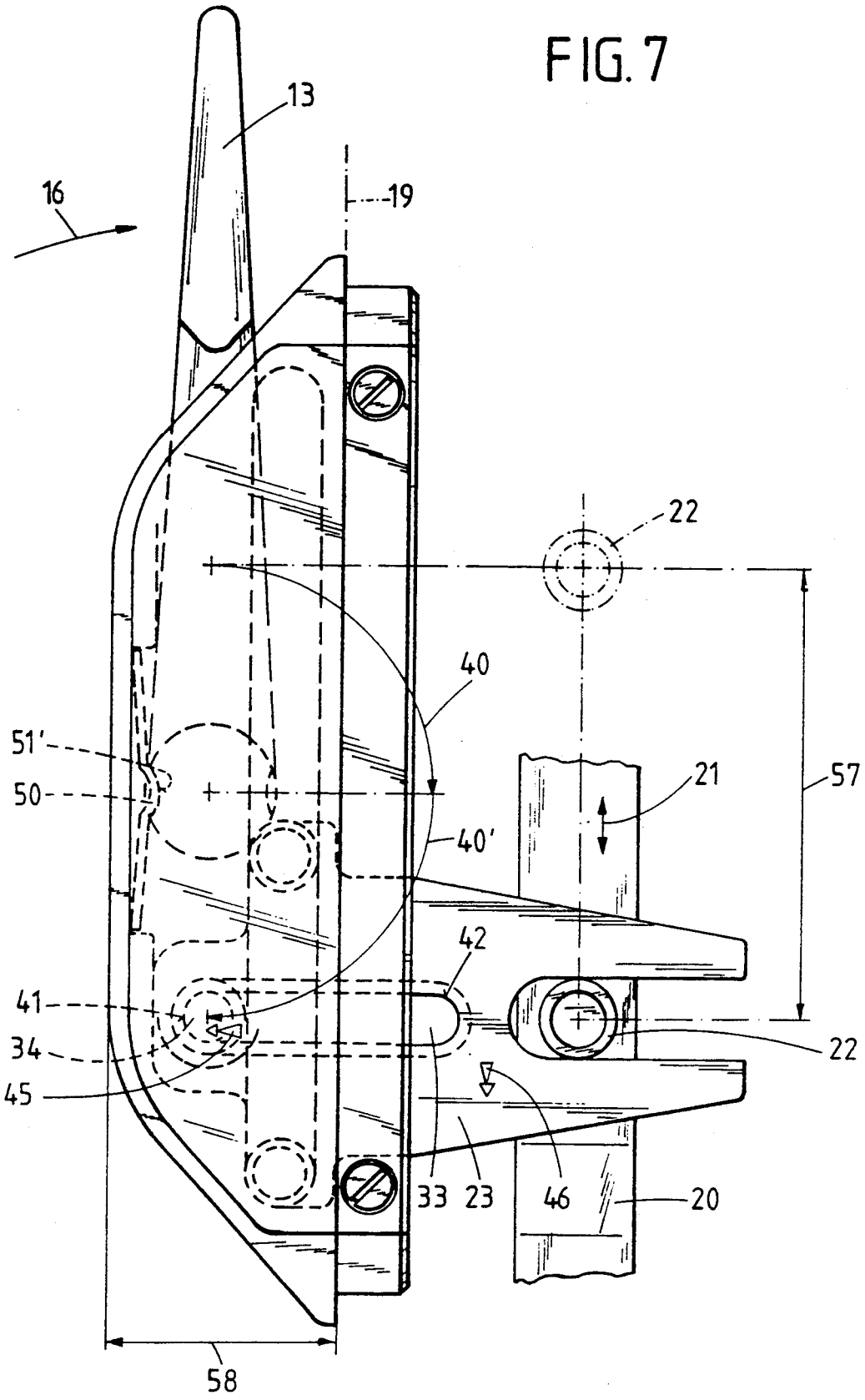
FIG. 7 is a side elevational view similar to that shown in FIG. 1 or 5 but with the handle in a third position corresponding to the open or unlocked position of the mobile part and spaced apart through an angle of approximately 180° from the position of FIG. 1.

The handle 13 can be releasably located and held in the position of FIG. 1 in a number of ways. FIG. 1 shows an internal stop 89 which abuts the crank 30, and FIG. 1 further shows a detent 50 which is provided to releasably retain the handle 13, the crank 30, the plate member 23 and the element 20 in the positions of FIG. 1. The detent 50 comprises two sockets or recesses 51 which are provided in the second end portion 44 of the crank 30 (remote from the pin 34 and roller 35) and each of which can receive a protuberance here shown as a rib 52 between two legs 53 of a leaf spring which constitutes the male detent member and is installed between the sections 10, 11 of the housing (see FIG. 3). The section or cover 11 has an aligning or locating portion 59 which abuts the adjacent side of the leaf spring to ensure that such spring is maintained in an optimum position between the two sections of the housing. The rib 52 enters the other recess 51' in the end portion 44 of the crank 30 when the handle 13 assumes the position which is shown in FIG. 7, i.e., at an angle of approximately 180° from the position of FIG. 1. The free end portions of the legs 53 of the leaf spring abut the adjacent internal shoulders 43 of the section 10.

Figure 5:
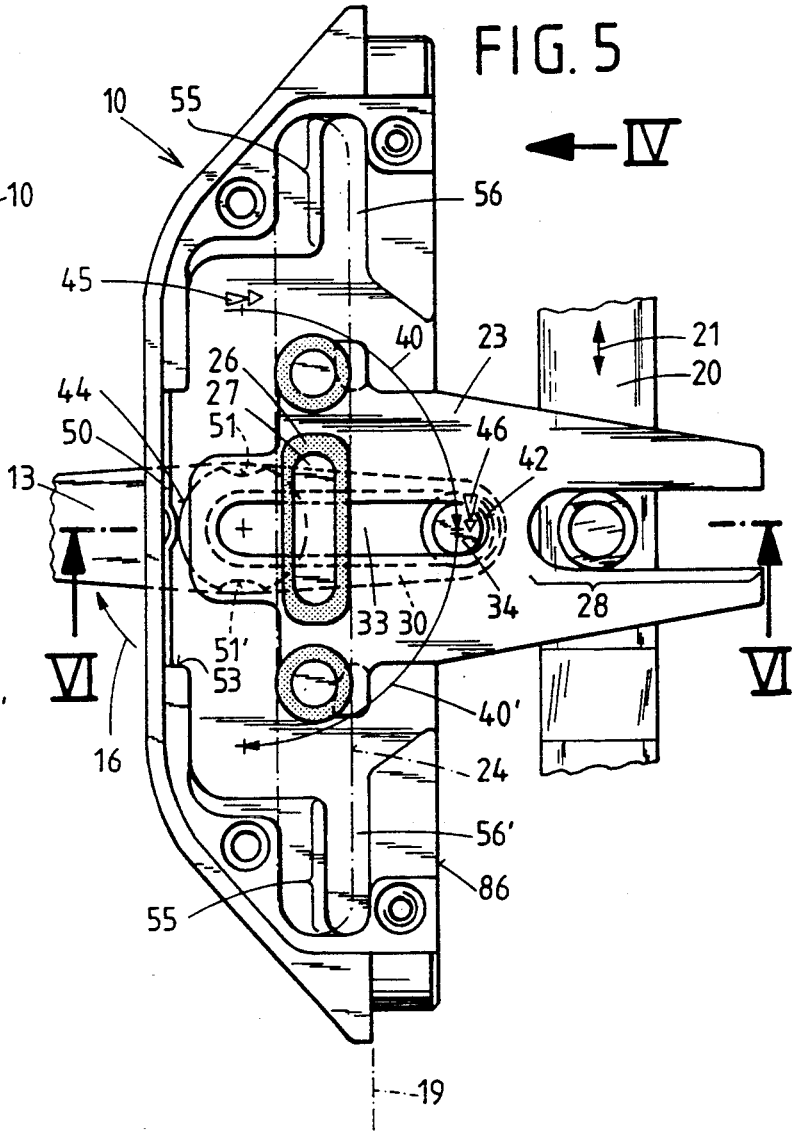
FIG. 5 is a side elevational view similar to that shown in FIG. 1 but with the handle shown in an intermediate position at an angle of substantially 90° from the position of FIG. 1.

In order to unlock the sash, a person must pivot the handles 13 in the direction of arrow 16, namely from the first position of FIG. 1 toward the intermediate position of FIG. 5 in which latter position the handle extends at right angles to the side 19 of the frame. As the handle 13 pivots from the position of FIG. 1 toward the position of FIG. 5, the pin 34 is caused to move along the first portion 40 of an arcuate path 40, 40' which forms part of a circular path and crosses the groove 24. More specifically, the projection of the arcuate path 40, 40' onto the internal surface 36 of the section 11 crosses the groove 24 in the internal surface 36. When the handle 13 reaches the position of FIG. 5, the pin 31 of the crank 30 (i.e., the pivot axis for the handle 13) is immediately adjacent the groove 24. During the initial stage of pivotal movement of the handle 13 from the position of FIG. 1 to the position of FIG. 5, the pin 34 on the end portion 32 of the crank 30 moves at right angles to the direction which is indicated by the arrow 21 (note the arrow 45 in FIG. 1). Since the slot 33 is normal to the direction which is indicated by the arrow 21, the pin 34 initially moves only in the longitudinal direction of the slot 33 (while the handle 13 moves away from the position of FIG. 1) so that the pin 34 and its roller 35 do not exert any, or any appreciable, pressure against the surfaces bounding the sides of the slot 33. In other words, the pin 34 and its roller 35 do not tend to push the plate member 23 in the direction of arrow 46. Consequently, the initial stage of pivoting of the handle 13 from the position of FIG. 1 necessitates the exertion of a relatively small force.

The force acting upon the plate member 23 in the direction of arrow 46 reaches a maximum value when the handle approaches and reaches the intermediate position of FIG. 5. When the handle 13 approaches and reaches the position of FIG. 5, the direction of movement of the pin 34 (arrows 40, 40' in FIG. 5) is at least substantially parallel to the direction which is indicated by the arrow 46, i.e., the plate member 23 is pushes in its own plane in the direction of arrow 46 and one of its prongs 28 entrains the element 20 in the same direction. At such time, and assuming that the handle 13 is pivoted or turned at a constant speed, the speed of the plate member 23 in the direction of arrow 46 reaches a maximum value.

FIG. 5 shows that the major part of the handle 13 extends at least substantially at right angles to the side 19 of the frame when the handle reaches its intermediate position. This is desirable and advantageous because a large portion (54, see FIG. 1) of the handle can be readily grasped by one hand of the operator in order to apply the force (acting in the direction of arrow 46) which is necessary to move the plate member 23 at a maximum speed and against maximum opposition of the member 23 and element 20. Thus, the required increase of the adjusting force is in consonance with the then prevailing ergonomical circumstances. Otherwise stated, the handle 13 can be turned about its pivot axis in a convenient manner even though the plate member 23 offers a maximum resistance to movement in the direction of arrow 46.

The pin 34 on the end portion 32 of the crank 30 is located in the other (right-hand) end 42 of the slot 33 when the handle 13 reaches the intermediate position of FIG. 5. The pin 34 is then actually located outside of the housing, i.e., it extends into the portion 90 of the plate member 23. This terminates the rightward stroke of the crank 30 which is then substantially parallel to the slot 33. The clearance 47 provides adequate room for movements of the crank 30 relative to the plate member 23 in the space immediately adjacent the internal surface 48 of the section 10.

The section 10 is provided with two receiving means or pockets 56 and 56' (hereinafter called pockets) which are provided in the end portions 55 and 55', respectively of the section 10. The distancing element 49 of the plate member 23 extends into the pocket 56 when the handle 13 assumes the position of FIG. 1, and the distancing element 49' extends into the pocket 56' when the handle reaches the position of FIG. 7. The rib 52 of the leaf spring forming part of the detent 50 engages a convex portion of the peripheral surface of the end portion 44 of the crank 30 when the handle 13 is maintained in the intermediate position of FIG. 5.

Further pivoting of the handle 13 in the direction of arrow 16 (namely beyond the position of FIG. 5) ultimately results in movement of the plate member 23 to the position of FIG. 7, namely to a position corresponding to that shown in FIG. 1. The handle 13 is then again substantially parallel to the side 19 of the fixed frame, and the pin 34 and its roller 35 are again received in the left-hand end portion 41 of the slot 33. The position of the plate member 23 in FIG. 7 is not the same as in FIG. 1, i.e., the plate member is located at the same distance from the leftmost portion of the housing including the sections 10, 11 but this plate member has been shifted in the longitudinal direction of the groove 24. The direction of movement of the pin 34 during pivotal movement of the handle 13 from the position of FIG. 5 to the position of FIG. 7 is indicated by the arrow 40'. The last stage of movement of the handle 13 to the position of FIG. 7 necessitates the exertion of a negligible effort because the pin 34 then moves in a direction substantially at right angles to the side 19, i.e., the extent of movement of the plate member 23 in the direction of arrow 46 is very small. The detent 50 becomes effective when the handle 13 reaches the position of FIG. 7, i.e., the crank 30 is then releasably held in that position in which its pin 34 is located in the left-hand end 41 of the slot 33. The rib 52 between the legs 53 of the leaf spring of the detent 50 is then received in the recess 51' in the peripheral surface of the end portion 44 of the crank 30. Furthermore, the crank 30 can abut a suitable stop in the section 10 of the housing as soon as the handle 13 reaches the position of FIG. 7.

FIG. 7 shows that the element 20 can cover a distance 57 (in the directions indicated by the double-headed arrow 21) in response to pivoting of the handle 13 between the positions of FIGS. 1 and 7. Such considerable distance 57 can be achieved in spite of the fact that the height (58 in FIG. 7) of the housing 10, 11 in a direction at right angles to the side 19 of the frame is surprisingly small.

As already mentioned above, the extent of movement of the plate member 23 and motion receiving element 20 longitudinally of the groove 24 is practically zero when the handle 13 is in the process of leaving the position of FIG. 1, in the process of approaching the position of FIG. 7, in the process of leaving the position of FIG. 7 or in the process of approaching the position of FIG. 1. This will be readily appreciated by looking at FIG. 7 wherein the arrows 40 and 40' indicate the paths of movement of the pin 34 and the end portions of such paths are practically parallel to the slot 33 in the plate member 23. This alone suffices to provide a certain self-locking action for the handle 13 and plate member 23 in the position of FIG. 1 or in the position of FIG. 7. Such self-locking action is particularly desirable in the position of FIG. 1, i.e., when the element 20 is held in a position corresponding to the locked position of the sash.

The self-locking action can be further enhanced in a manner as shown in FIG. 1. Thus, the handle 13 is movable from the solid-line (first) position of FIG. 1 in the direction of arrow 16' beyond such solid-line position to an over-the-dead-center position 61. Such movement of the handle 13 is possible by lengthening the slot 33 in a direction to the left, as viewed in FIG. 1, 5 or 7, so that the handle 13 is pivotable or turnable to 61 but the position of the plate member 23 remains unchanged. Pivoting of the handle 13 from the solid-line position to the position 61 of FIG. 1 results in a movement of the pin 34 in the direction of arrow 60. The pivot axis of the pin 31 (i.e., the pivot axis for the handle 13) is then nearer to the side 19 than the axis of the pin 34. This enhances the self-locking action and necessitates the exertion of a very large force in order to forcible move the sash away from the side 19 of the frame when the handle 13 assumes the position 61. In other words, a burglar who does not wish to break one or more window panes is confronted with a task of exerting a very large force in order to forcibly open the window or door wherein the sash is held in locked position by a handle 13 assuming the position 61 of FIG. 1, namely at less than the average distance 62 from the side 19 of the frame. In fact, an attempt to forcibly open the window or door will result in an even more pronounced tendency of the plate member 23 and crank 30 to remain in the end positions of FIG. 1, i.e., to oppose a movement toward the positions of FIG. 5.

The improved device can be used with equal advantage on the right-hand or the left-hand stile or elsewhere in a stationary frame or in a mobile frame, such as a sash of a door or window.

FIGS. 8 through 11 illustrate certain details of a modified device. All such parts of the modified device which are identical with or clearly analogous to corresponding parts of the device shown in FIGS. 1 through 7 are denoted by similar reference characters. An important difference between the two devices is that the plate member 23 of the modified device is indirectly connected with the crank 30, namely, by a link 70.

The connection further comprises a first fulcrum 71 which defines a pivot axis parallel to the pivot axis defined by the pin 31 for the handle 13, and a second fulcrum 72 which defines a third pivot axis parallel to the axis defined by the fulcrum 71. The fulcrum 71 establishes an articulate connection between one end of the link 70 and the plate member 23, and the fulcrum 72 establishes an articulate connection between the other end of the link 70 and the end portion 32 of the crank 30.

Figure 8:
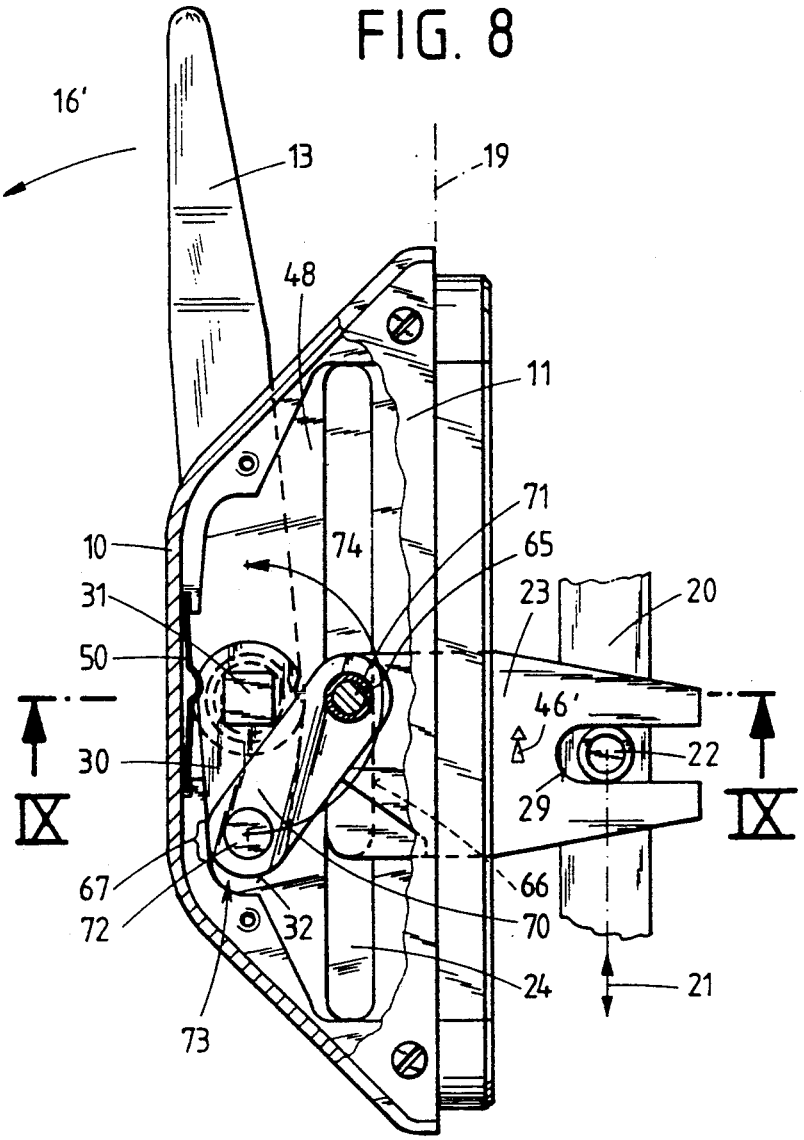
FIG. 8 is a view similar to that of FIG. 7 but showing a modified device wherein the power train between the handle and the motion receiving element or elements comprises a link, a portion of the housing being broken away.
Figure 11:
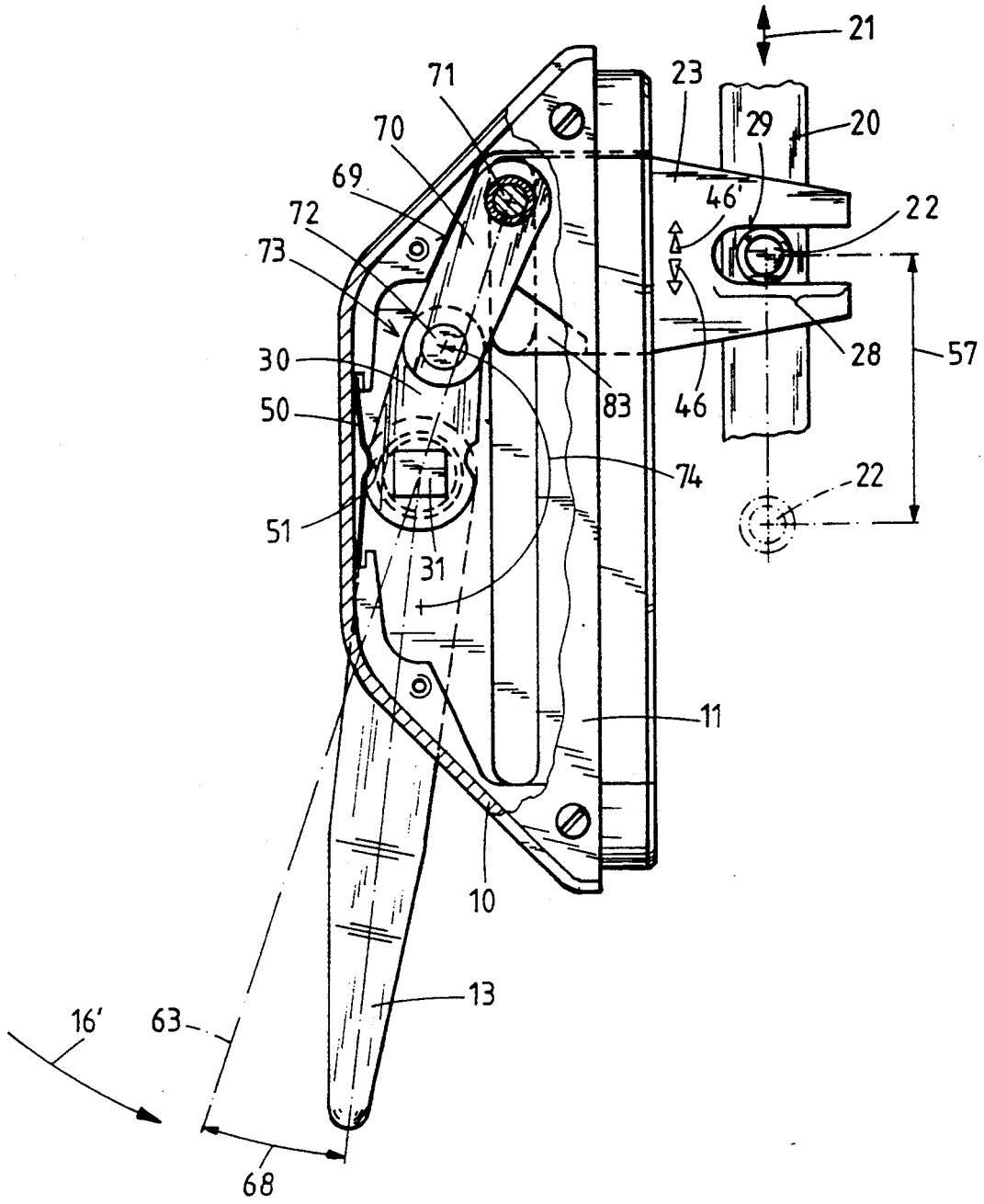
FIG. 11 is a view similar to that of FIG. 8 but showing the handle of the modified device in a position corresponding to that of the handle which is shown in FIG. 1.

As can be readily seen in FIGS. 8 and 11, the crank 30 and the link 70 define or form a toggle joint 73. These parts of the toggle joint make an acute angle when the handle 13 is maintained in the second position (FIG. 8) but the crank 30 is at least substantially aligned with the link 70 when the handle 13 is caused to assume the (first) position of FIG. 11. As in the device of FIGS. 1 through 7, the handle 13 is substantially parallel to the side 19 of the fame when the parts 30, 70 of the toggle joint 73 assume the positions of FIG. 8 or 11. The arrow 74 denotes in FIG. 8 the path of movement of the fulcrum 71 when the handle 13 is turned from the position of FIG. 8 (sash unlocked) toward the position of FIG. 11 (sash locked to the frame including the side 19).

Figure 9:
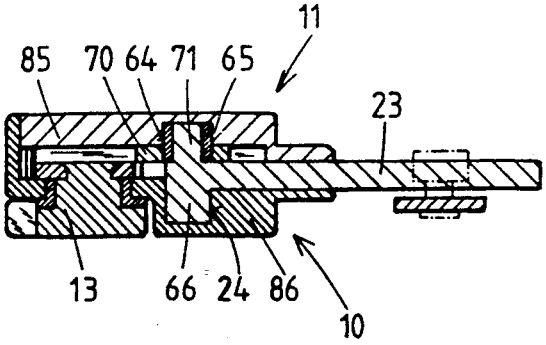
FIG. 9 is a sectional view substantially as seen in the direction of arrows from the line IX—IX in FIG. 8.
Figure 10:
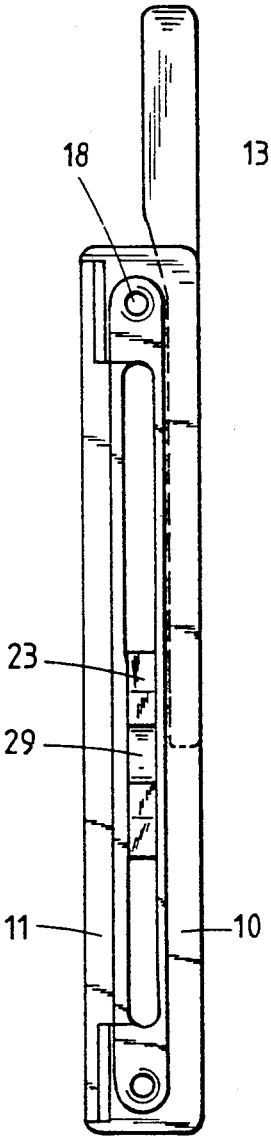
FIG. 10 is an end elevational view of the modified device.

FIG. 9 shows that the housing section 10 is provided with the groove 24 (the groove 24 for the followers or sliders 25, 26, 25 of the plate member 23 shown in FIGS. 1 through 7 is provided in the section 11) and that the housing section 11 is provided with a second groove or guide groove 64 which is machined into or is otherwise formed in the internal surface of the wall 85. That side of the plate member 23 which is adjacent the internal surface of the wall 86 is provided with an elongated substantially oval slider 66 extending into the groove 24, and the fulcrum 71 carries a roller follower 65 which can be said to constitute a follower or slider and extends into the guide groove 64.

The device of FIGS. 8 through 11 also comprises a detent 50 which can releasably hold the crank 30 in the end position of FIG. 8 or in the end position of FIG. 11. An internal shoulder 67 of the housing section 10 serves as an abutment or stop for the link 70 when the latter reaches the end position of FIG. 8.

When the handle 13 is pivoted from the position of FIG. 8 in the direction of arrow 16' toward the position of FIG. 11, the toggle joint 73 moves the plate member 23 in the direction of arrow 46'. The extent of such movement increases gradually while the handle 13 turns from the position of FIG. 8 to a position corresponding to that of the handle 13 shown in FIG. 5, namely substantially at right angles to the side 19 of the frame. In order to ensure that the crank 30 will not collide with the plate member 23 during the just mentioned turning of the handle 13 from the position of FIG. 8 through an angle of approximately 90°, the plate member 23 is provided with a depression or recess 83 (FIG. 11) which is configurated to permit entry of the crank 30 so that the crank can be moved all the way to the position of FIG. 11 and can enter the recess 83 when the handle 13 reaches an intermediate position corresponding to that of the handle 13 shown in FIG. 5.

The force with which the handle 13 must be pivoted from the position of FIG. 8 toward the position of FIG. 11 increases during movement of the handle 13 toward the position corresponding to that of the handle 13 shown in FIG. 5, and such force thereupon decreases as the handle moves from the intermediate position toward the position of FIG. 11 which corresponds to that of the handle 13 shown in FIG. 1. When the handle 13 reaches the position of FIG. 11, the aforementioned three axes (namely the pivot axis defined by the pin 31 for the handle 13, the axis of the fulcrum 71 and the axis of the fulcrum 72) are located at least close to a common plane. This can be termed the dead-center position of the parts 30, 70 of the toggle joint 73.

FIG. 11 shows that the handle 13 can be turned beyond the solid-line position (in which the three axes are located in or at least very close to a common plane), namely through an acute angle 68 to assume the position 63 in which the device of FIGS. 8 through 11 is locked to prevent unintentional or accidental unlocking of the sash from the frame including the side 19.

The toggle joint 73 (and more specifically at least the link 70) engages an internal abutment or stop 69 of the housing section 10 when the handle 13 assumes the solid-line position of FIG. 11. At the same time, the detent 50 is effective to releasably hold the handle 13, the crank 30, the link 70, the plate member 23 and the motion receiving element 20 in the positions shown in FIG. 11. It will be seen that the axis of the fulcrum 72 is then located to the left of a plane including the axis of the fulcrum 71 and the pivot axis of the handle 13 (such plane is denoted by the aforementioned phantom line 63 which further denotes the extreme position of the handle 13)(subsequent to movement through the angle 68 beyond the solid-line position of FIG. 11). It can be said that, at such time, the longitudinal directions of the link 70 and crank 30 make a large oblique angle, i.e., an angle slightly less than 180°. This is the so-called beyond-the-dead-center position of the toggle joint 73. The plate member 23 is then maintained in a position corresponding to the operative or "locking" position of the motion receiving element 20. If the pivot axis of the handle 13 is horizontal or nearly horizontal, this handle preferably extends downwardly (as shown in FIGS. 1 and 11) when the sash is locked to the frame.

If an unauthorized person attempts to forcibly open the window or door which embodies the structure of FIGS. 8 through 11 (while the handle 13 is maintained in the solid-line position of FIG. 11), a burglar tool is used to urge the plate member 23 and/or the element 20 in the direction of arrow 46, the toggle joint 73 is even more strongly urged against the stop 69 of the housing section 10. Thus, the tendency of the handle 13 to remain in the solid-line position of FIG. 11 is increased or enhanced in response to an unauthorized attempt to move the sash relative to the frame, i.e., the plate member 23 opposes a movement of the element 20 in a direction to unlock the mechanism with an even greater force.

The advantages of the device of FIGS. 8 through 11 are the same as those outlined in connection with the embodiment of FIGS. 1 through 7. Thus, the plate member 23 can cover a considerable distance 57 (FIG. 11) even though the housing extends only through a short distance beyond the side 19 of the frame.

If desired or necessary, the improved device can be furnished with a lock which can maintain the handle 13 in a selected angular position until and unless an authorized person produces a key 76 (FIG. 13) or an analogous part which must be properly manipulated in order to unlock a previously blocked part, such as the link 70, the crank 30, the plate member 23, the element 20 (not shown in FIGS. 12–13) and/or the handle 13. This is shown in FIGS. 12 and 13 illustrating a device wherein the section or cover 11 of the housing carries a cylinder lock 75 having a turnable and/or axially reciprocable part 78 which can be released by the key 76 so that it then moves in the direction of arrow 77 to cause a locking pin 79 or an analogous part (hereinafter called bolt) to enter a hole 80 of the link 70 and to thus positively lock the parts 23, 73, 13 in the positions shown in FIG. 12.

Figure 13:
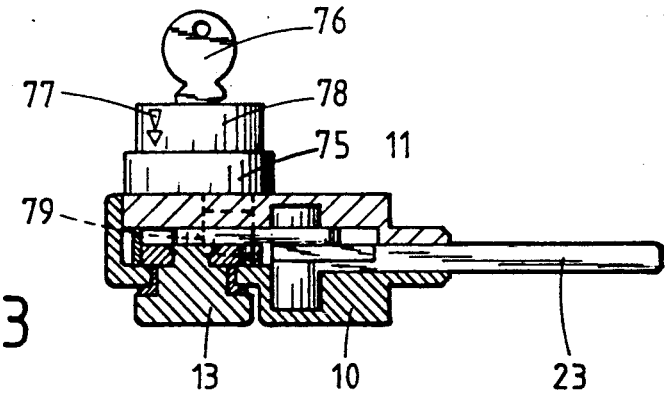
FIG. 13 is a sectional view substantially as seen in the direction of arrows from the line XIII—XIII in FIG. 12.
Figure 12:
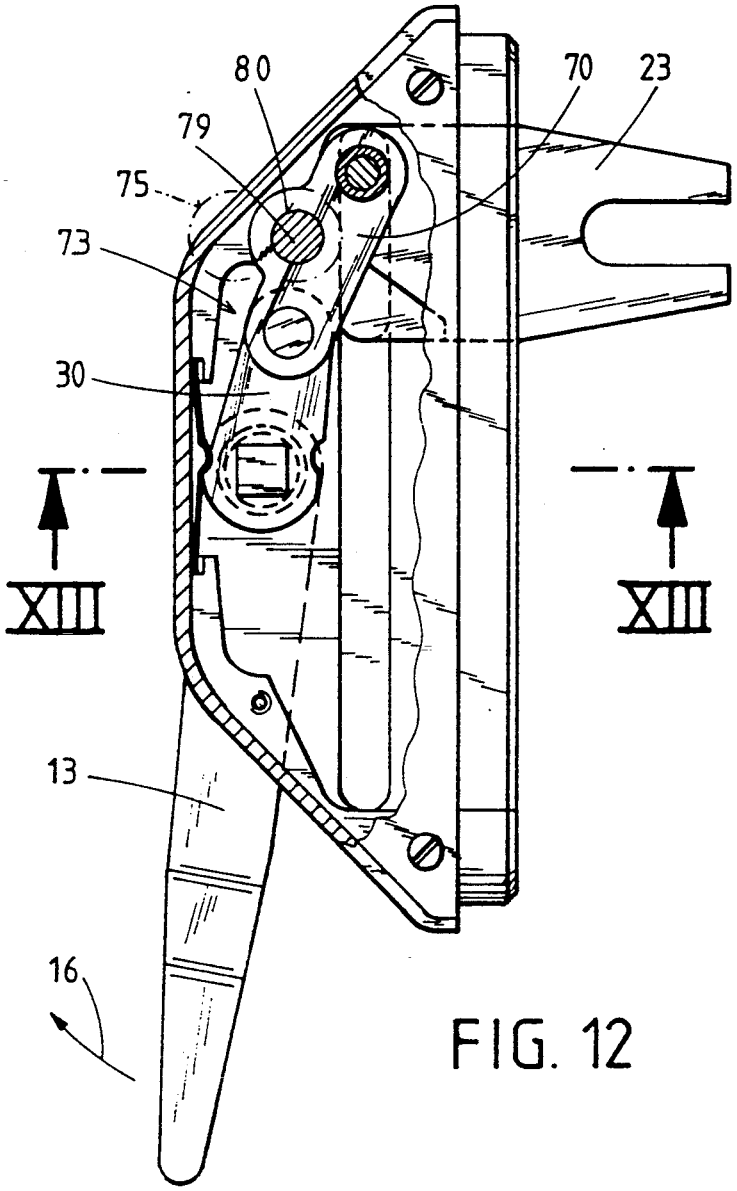
FIG. 12 is a side elevational view of a third device which constitutes a modification of the device shown in FIGS. 8 through 11 and further embodies a lock which can positively fix certain mobile parts in selected positions.

The lock 75 or an equivalent or similar lock can be installed in or on the housing including the sections 10, 11 subsequent to installation of the device of FIGS. 12 and 13 in a mobile or in a stationary frame, e.g., in a door or window frame or in a door or window sash.

The hole 80 can be dimensioned in such a way that it permits entry of the bolt 79 only and alone when the handle 13 assumes the angular position of FIG. 12, namely that position in which the sash is locked to a door or window frame.

The key 76 can be extracted from the keyhole of the cylinder lock 75 when the depression of the bolt 79 to the position of FIG. 12 (in which the sash is locked) is completed. The bolt 79 then remains in such position until and unless an authorized person produces the key 76. Insertion of the key into the keyhole of the lock 75 results in automatic extraction of the bolt 79 from the hole 80 (e.g., in response to dissipation of energy by one or more springs, not shown), or the person in charge is in a position to extract the bolt 79 and to thus free the handle 13 for pivotal movement from the position of FIG. 12 to a position corresponding to that shown in FIG. 7 or 8.

Figure 14:
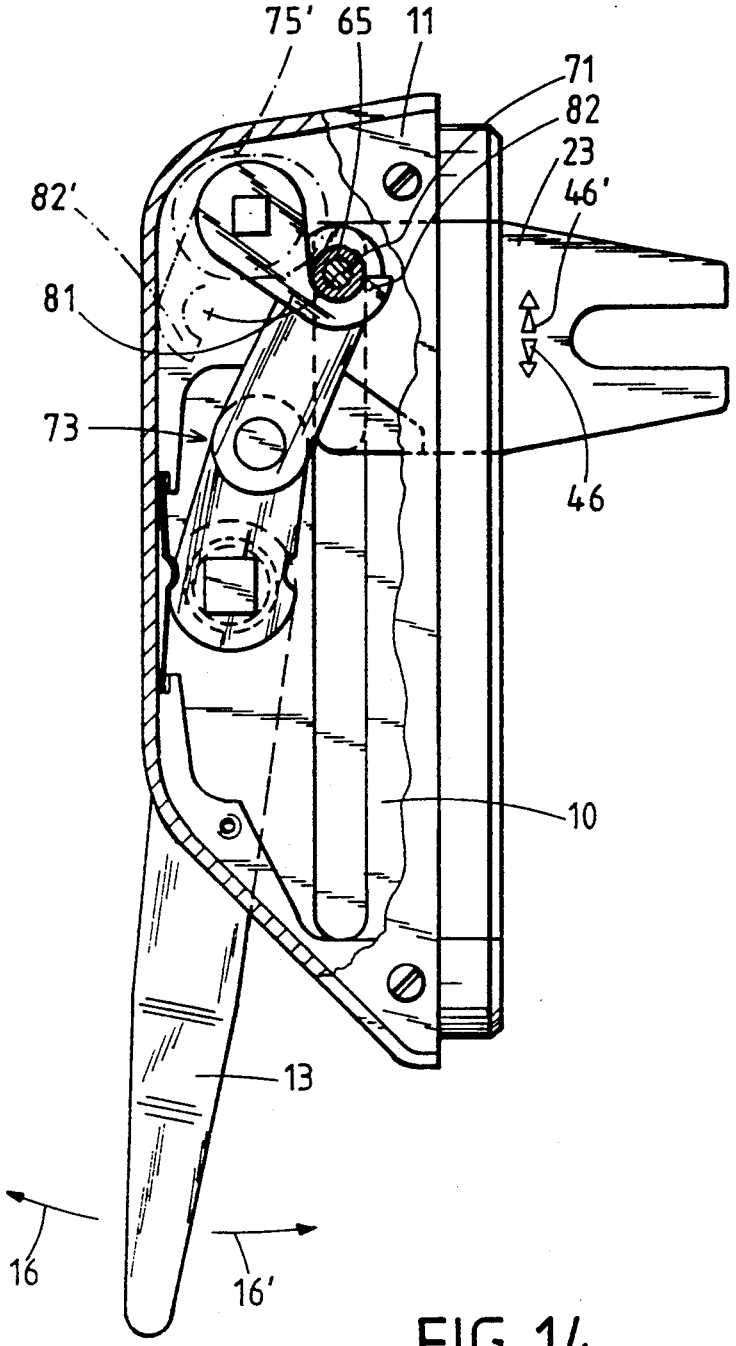
FIG. 14 is a side elevational view of a fourth device which constitutes a modification of the device of FIGS. 12–13 in that it is equipped with a different lock, the housing being partly broken away.

FIG. 14 illustrates a portion of a fourth device which employs a modified cylinder lock 75' (the housing of such lock is indicated by a broken-like circle). The lock 75' is mounted on or in the section 11 (not shown) of the housing and can be actuated by a key (not shown) in a manner as described with reference to FIGS. 12–13 or in any other suitable way. The locking bolt 81 of the lock 75' constitutes or includes a hook 82 which is normally located adjacent the path of movement of the toggle joint 73 (note the position 82') but can interfere with the movements of the parts of such toggle joint when the operator of the lock 75' so decides. When the hook 82 assumes the solid-line position of FIG. 14, it engages the fulcrum 71 and positively holds the plate member 23 against movement in the direction of arrow 46. Instead of engaging the fulcrum 71, the hook 82 of the bolt 81 can be designed and/or configurated to engage a suitable projection of the plate member 23. FIG. 14 shows that the hook 82 actually engages the roller follower 65 on the fulcrum 71, i.e., the device of FIG. 14 can be designed in a manner as described with reference to and as shown in FIGS. 8 through 11.

An important advantage of the improved device is that the housing is assembled of the sections 10 and 11. This simplifies the installation of various component parts in the housing and establishes the opening 37 for the second portion 90 of the plate member 23. The machining or any other mode of making the groove 24 or the grooves 24 and 64 is also simplified by employing a composite housing including the sections 10 and 11. The plate member 23 can be assembled with the motion receiving element 20 and/or with the crank 30 or toggle joint 73 prior to its insertion between the two sections 10, 11 of the housing.

The positioning of the handle 13 relative to the sections 10, 11 of the housing in a manner as shown in FIGS. 1–7 or in FIGS. 8–14 contributes to compactness of the device in that the handle remains or can remain in the plane of the wall (such as the wall 86 shown in FIG. 3) of one of the housing sections.

The feature that the handle 13 is pivotable through an angle well in excess of 90° (preferably at least close to 180°) contributes to convenience of manipulation of the handle without unduly increasing the overall height of the housing.

The embodiment of FIGS. 1–7 is simpler than the embodiment of FIGS. 8–14 because the crank 30 is used to directly couple the handle 13 to the plate member 23. As already described above, the arrangement is preferably such that the link 30 is disposed at one side and the groove 24 is located at the other side of the plate member 23.

An advantage of the feature that the path (arrows 40, 40' in FIG. 5) crosses the groove 24 in the device of FIGS. 1–7 is that the groove 24 can be placed into close proximity to the pivot axis (pin 31) for the handle 13 which renders it possible to reduce the overall height of the housing.

The feature that the plate member 23 is not tiltable but is merely reciprocable relative to the housing exhibits the advantage that the plate member always assumes an optimum position relative to the motion receiving element 20 regardless of the momentary angular position of the handle 13. Furthermore, the device can employ a very simple and compact motion transmitting connection (follower 22 and prongs 28) between the plate member 23 and the motion receiving element 20. The relatively simple connection between the member 23 and the element 20 reduces the likelihood of jamming of the device, at least at the locus of connection between the plate member 23 and the motion receiving element 20. Moreover, the simplicity of the just discussed connection renders it possible to reduce the force which is required to manipulate the handle 13 because the transmission ratio between the handle and the plate member 23 and element 20 is highly satisfactory.

The extent of movability of the element 20 in response to movement of the plate member 23 along the groove 24 can be selected practically at will by the simple expedient of properly selecting the effective length of the crank 30 between its end portions 32 and 44.

As already described above, and as shown in the drawings, the slot 33 of the plate member 23 can extend from the housing. This renders it possible to move the axis of the pin 34 along an arcuate path 40, 40' (FIG. 5) which extends in part outwardly of and beyond the housing including the sections 10 and 11. Such path for the axis of the pin 34 can be selected even in an embodiment wherein the portion 90 of the plate member 23 extends from the housing.

The handle 13 need not be bulky or very long because the movements of the plate member 23 relative to the groove 24 can be effected with the exertion of a relatively small force. This renders it possible to reduce the overall space requirements of the improved device. Though it is possible to reduce the angle of pivotability or turnability of the handle 13 about the axis of the pin 31, the selection of a relatively large angle (more than 90° and at least close to 180°) is preferred at this time. The selected magnitude of this angle can determine the extent of movability of the plate member 23 along the groove 24.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A device for actuating a mechanism for releasably securing a mobile frame to a second frame, comprising a housing including a first section and a second section, said sections having external surfaces and confronting internal surfaces; means for fastening at least one of said sections to one side of one of the frames; a pivot carried by said housing and defining a pivot axis at least substantially parallel to the one side of the one frame; a handle mounted on said pivot adjacent one of said external surfaces and turnable about said axis through an angle of at least 90° in a predetermined plane which is at least substantially parallel to at least one of said internal surfaces; a plate member including a first portion movably mounted between said sections and a second portion extending outwardly from said housing through an opening provided between said sections adjacent the one side of the one frame, said plate member having a first side and a second side; motion receiving means connected to the second portion of said plate member and to the securing mechanism; and means for coupling the first portion of said plate member to said handle to impart to said motion receiving means a substantially linear movement in a predetermined direction in response to turning of said handle about said axis, said coupling means comprising at least one follower provided on said plate member and reciprocable in a groove provided in one of said internal surfaces adjacent one side of said plate member and extending in substantial parallelism with said direction, a crank turnable with said handle and disposed between said sections adjacent the other side of said plate member, and means for at least indirectly connecting an end portion of said crank to said plate member, said end portion of said crank being movable—in response to turning of said handle—along an arcuate path crossing said groove and disposed in a plane at least substantially parallel to the one side of the one frame.

2. The device of claim 1, wherein said plate member is located in a plane at least substantially normal to the one side of the frame, said motion receiving means being movable between a first position in which a mobile sash is secured to the frame and a second position in which the sash is movable relative to the frame, said first and second sections respectively including first and second walls and said internal surfaces being provided on the respective walls, said handle being turnable through an angle of approximately 180° and said crank being adjacent the internal surface of that section which includes said one external surface, said arcuate path constituting a portion of a substantially circular path.

3. The device of claim 1, wherein said means for at least indirectly connecting comprises a projection provided on said end portion of said crank and extending into a slot provided in said plate member and extending at least substantially at right angles to the one side of the frame.

4. The device of claim 3, wherein said slot includes first and second portions respectively provided in the first and second portions of said plate member, said slot crossing the groove in said one internal surface.

5. The device of claim 3, wherein said plate member comprises two distancing elements adjacent the other of said internal surfaces and flanking said slot, said handle being turnable between spaced-apart first and second positions and the section including said other internal surface having two pockets, one of said pockets receiving one of said distancing elements in the first position of said handle and the other of said pockets receiving the other of said distancing elements in the second position of said handle.

6. The device of claim 3, wherein said slot has first and second ends and said plate member is movable by said crank between a first end position in which said projection is disposed at one end of said slot, through a plurality of intermediate positions including a predetermined intermediate position in which said projection is at least close to the other end of said slot, and a second end position in which said projection is again located at said one end of said slot.

7. The device of claim 3, wherein said plate member is movable between said sections between first and second end positions in response to turning of said handle about said axis to first and second positions, respectively, said projection being nearer to the one side of the frame than said axis at least in the first position of said handle and said handle being further turnable to an end position beyond said first position and away from said second position to thereby locate said projection farther away from the one side of the frame than said axis.

8. The device of claim 1, wherein said means for at least indirectly connecting further comprises a link which is articulately connected with said end portion of said crank and is further connected to said plate member, said link and said crank forming a toggle joint and said plate member being movable by said handle between first and second end positions, said link and said crank being inclined relative to each other in one end position of said plate member and said link being at least substantially aligned with said crank in the other end position of said plate member.

9. The device of claim 8, wherein said means for at least indirectly connecting further comprises a first fulcrum connecting said link with said crank and defining a second axis parallel to said pivot axis, and a second fulcrum connecting said link with said plate member and defining a third axis parallel to said second axis, said plate member being movable between first and second end positions in response to turning of said handle between first and second positions, respectively, said second axis being disposed at least close to a common plane of said pivot axis and said third axis in the first end position of said plate member and said handle being turnable about said pivot axis beyond said first position and away from said second position to locate said second axis at one side of said common plane.

10. The device of claim 8, wherein said means for at least indirectly connecting further comprises a fulcrum connecting said link with said plate member and defining a second axis parallel to said pivot axis, said fulcrum having an axial extension extending into a guide groove provided in the other of said internal surfaces.

11. The device of claim 10, wherein said extension has a lubricant-containing chamber.

12. The device of claim 8, wherein said plate member is movable between first and second end positions in response to turning of said handle, said housing having at least one stop positioned to prevent a movement of said toggle joint beyond a position corresponding to at least one of said first and second end positions.

13. The device of claim 1, wherein said plate member is movable relative to said sections between first and second end positions in response to turning of said handle to first and second positions, respectively, and further comprising a detent having means for releasably holding said handle in at least one of said first and second positions.

14. The device of claim 13, wherein said detent comprises at least one recess in said crank and a male detent member provided on said housing to enter said at least one recess in said at least one position of said handle.

15. The device of claim 14, wherein said male detent member comprises a leaf spring having two legs mounted in one of said sections and a protuberance disposed between said legs and entering said at least one recess in said at least one position of said handle, the other of said sections having means for maintaining said legs in predetermined positions relative to said one section.

16. The device of claim 1, wherein said one external surface has a depression for a portion of said handle.

17. The device of claim 1, wherein said at least one follower comprises at least one slider having a lubricant-containing chamber.

18. The device of claim 17, wherein said at least one slider comprises a roller.

19. The device of claim 1, further comprising locking means provided on one of said sections and having a movable locking element and means for effecting a movement of said locking element into and from locking engagement with at least one of said plate member, said handle and said crank.

20. The device of claim 1, wherein said plate member is movable between first and second end positions in response to turning of said handle, said housing having at least one stop positioned to prevent a movement of said plate member beyond at least one of said end positions.

* * * * *